US009838817B2

(12) United States Patent
Chang et al.

(10) Patent No.: US 9,838,817 B2
(45) Date of Patent: Dec. 5, 2017

(54) LOUDSPEAKER DIAPHRAGM AND MANUFACTURING METHOD THEREOF

(71) Applicant: GOERTEK INC., WeiFang (CN)

(72) Inventors: Xiuli Chang, WeiFang (CN); Yonghua Zhang, WeiFang (CN); Chengzong Ji, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/103,231

(22) PCT Filed: Apr. 24, 2014

(86) PCT No.: PCT/CN2014/076121
§ 371 (c)(1),
(2) Date: Jun. 9, 2016

(87) PCT Pub. No.: WO2015/085697
PCT Pub. Date: Jun. 18, 2015

(65) Prior Publication Data

US 2016/0295329 A1 Oct. 6, 2016

(30) Foreign Application Priority Data

Dec. 9, 2013 (CN) ..... 2013 1 0660783

(51) Int. Cl.
*H04R 31/00* (2006.01)
*H04R 7/10* (2006.01)
*H04R 7/12* (2006.01)

(52) U.S. Cl.
CPC ..... *H04R 31/003* (2013.01); *H04R 7/10* (2013.01); *H04R 7/127* (2013.01); *H04R 7/125* (2013.01);
(Continued)

(58) Field of Classification Search
CPC . H04R 31/003; H04R 7/127; H04R 2231/001
See application file for complete search history.

(56) References Cited

U.S. PATENT DOCUMENTS 4,140,203 A * 2/1979 Niguchi ..... G10K 13/00 181/166
4,377,617 A 3/1983 Ikei et al.
2013/0315435 A1* 11/2013 Sato ..... H04R 7/02 381/412

FOREIGN PATENT DOCUMENTS

CN 1516521 A 7/2004
CN 1756445 A 4/2006
(Continued)

OTHER PUBLICATIONS

International Search Report for International Patent Application No. PCT/CN2014/076121 dated Aug. 8, 2014.
(Continued)

*Primary Examiner* — Matthew Eason

(57) ABSTRACT

A loudspeaker diaphragm, comprising a dome portion located at central position and a suspension ring portion located at edge position; the dome portion and/or the suspension ring portion comprise silk fabric and thermoplastic polyurethane combined with the silk fabric; and the silk fabric is coated with thermosetting adhesive. The method for manufacturing the loudspeaker diaphragm comprises following steps: a. coating the silk fabric with a thermosetting adhesive under a high temperature, and drying the silk fabric; b. hot pressing and combining the silk fabric and thermoplastic polyurethane to form a membrane; c. pressing the membrane to form the dome portion and/or the suspension ring portion. The dome portion, or both the dome portion and the suspension ring portion of the loudspeaker diaphragm comprise silk fabric coated with a thermosetting adhesive and thermoplastic polyurethane. Thus formed loudspeaker diaphragm has good rigidity and damping characteristic, thus improving acoustic performance of the diaphragm.

2 Claims, 3 Drawing Sheets

(52) U.S. Cl.
CPC .. *H04R 2231/001* (2013.01); *H04R 2307/021* (2013.01); *H04R 2307/025* (2013.01); *H04R 2307/029* (2013.01)

(56) References Cited

FOREIGN PATENT DOCUMENTS

| | | | |
|---|---|---|---|
| CN | 101420651 | A | 4/2009 |
| CN | 202395975 | U | 8/2012 |
| CN | 202514062 | U | 10/2012 |
| CN | 103686547 | A | 3/2014 |
| CN | 203708459 | U | 7/2014 |
| DE | 2003815 | B | 4/1971 |
| JP | H07-284194 | A | 10/1995 |
| JP | 2001-204094 | A | 7/2001 |

OTHER PUBLICATIONS

Office Action from Chinese Patent Office for Application No. 201310660783.1 dated Sep. 2, 2016.
Office Action from Chinese Patent Office for Application No. 201310660783.1 dated Mar. 22, 2016.
Office Action from Korean Patent Office for Application No. 10-2016-7018407 dated Dec. 20, 2016.

* cited by examiner

LOUDSPEAKER DIAPHRAGM AND MANUFACTURING METHOD THEREOF

CROSS-REFERENCE TO RELATED APPLICATIONS

The present specification is a U.S. National Stage of International Patent Application No. PCT/CN2014/076121 filed Apr. 24, 2014, which claims priority to and the benefit of Chinese Patent Application No. 201310660783.1 filed in the Chinese Intellectual Property Office on Dec. 9, 2013, the entire contents of which are incorporated herein by reference.

TECHNICAL FIELD

The present invention relates to the acoustoelectric product technical field, and more particularly, to a loudspeaker diaphragm and a method of manufacturing the loudspeaker diaphragm.

BACKGROUND ART

A loudspeaker diaphragm with single-layer structure only has basic characteristics of the single-layer material itself, and is difficult to meet the requirements of the loudspeaker diaphragm. At present, the loudspeaker diaphragm adopts multi-layer compound structure, but the material used for the diaphragm is generally difficult to satisfy both rigidity and damping characteristic of the diaphragm. Generally, the diaphragm having a greater rigidity has a smaller damping, and the diaphragm having a greater damping has a smaller rigidity, both of which can't satisfy the requirements on the diaphragm of the existing loudspeaker, and more particularly, the high-frequency loudspeaker. Thus, there is a need to improve the loudspeaker diaphragm with such a structure, and the method of manufacturing the loudspeaker diaphragm to avoid the above defects.

SUMMARY

The technical problem to be solved by the present invention is to provide a loudspeaker diaphragm and a method of manufacturing the loudspeaker diaphragm, which can satisfy both rigidity and damping characteristic of the diaphragm, and improve the acoustic performance of the diaphragm.

In order to solve the above technical problem, the technical solution of the present invention is a loudspeaker diaphragm comprising a dome portion located at the central position and a suspension ring portion located at the edge position, wherein, the dome portion, or both the dome portion and the suspension ring portion comprise a silk fabric and a thermoplastic polyurethane combined with the silk fabric, wherein, the silk fabric is coated with a thermosetting adhesive.

Moreover, a preferred scheme is that, the silk fabric and the thermoplastic polyurethane are combined with each other through hot pressing.

Moreover, a preferred scheme is that, two surfaces of the silk fabric are coated with the thermosetting adhesive.

Moreover, a preferred scheme is that, only one surface of the silk fabric is coated with the thermosetting adhesive.

Moreover, a preferred scheme is that, the thermosetting adhesive is between the silk fabric and the thermoplastic polyurethane.

Moreover, a preferred scheme is that, the silk fabric is between the thermosetting adhesive and the thermoplastic polyurethane.

A method of manufacturing the loudspeaker diaphragm described above, wherein, the method comprises the following steps:

step a: coating the silk fabric with an adhesive under a high temperature, and drying the silk fabric coated with the adhesive, wherein, the adhesive is a thermosetting adhesive;

step b: combining the silk fabric, which is coated with the adhesive in the step a, and the thermoplastic polyurethane through hot pressing, so as to form a membrane;

step c: pressing the membrane formed in the step b under a high temperature to form the dome portion, or both the dome portion and the suspension ring portion.

Moreover, a preferred scheme is that, in the step c, said pressing the membrane comprising using two molds comprising an upper mold and a lower mold, and during the pressing, the thermoplastic polyurethane is contacted with the upper mold, and the silk fabric coated with the thermosetting adhesive is contacted with the lower mold.

Moreover, a preferred scheme is that, the temperature of the upper mold is not higher than that of the lower mold.

Moreover, a preferred scheme is that, in the step c, both the thermosetting adhesive and the thermoplastic polyurethane in the membrane are in a molten state under the high temperature.

After adopting the above technical solution, compared with the conventional structure, the dome portion, or both the dome portion and the suspension ring portion of the loudspeaker diaphragm of the present invention comprise the silk fabric coated with the thermosetting adhesive, and the thermoplastic polyurethane combined with the silk fabric through hot pressing. Since the silk fabric has rigidity after being coated with the adhesive, and the thermoplastic polyurethane has a greater internal damping, the loudspeaker diaphragm formed by combining such two materials has superior rigidity and damping characteristic, thereby improving the acoustic performance of the diaphragm, and particularly, improving the high-frequency acoustic performance of the diaphragm.

BRIEF DESCRIPTION OF THE DRAWINGS

The above features and technical advantages of the present invention will become more clear and easy to understand through the descriptions of the present invention in connection with the accompanying drawings below.

DETAILED DESCRIPTION OF EMBODIMENTS

Hereinafter, the present invention will be further described in details in connection with the accompanying drawings and specific embodiments.

Embodiment 1

Figure 1:
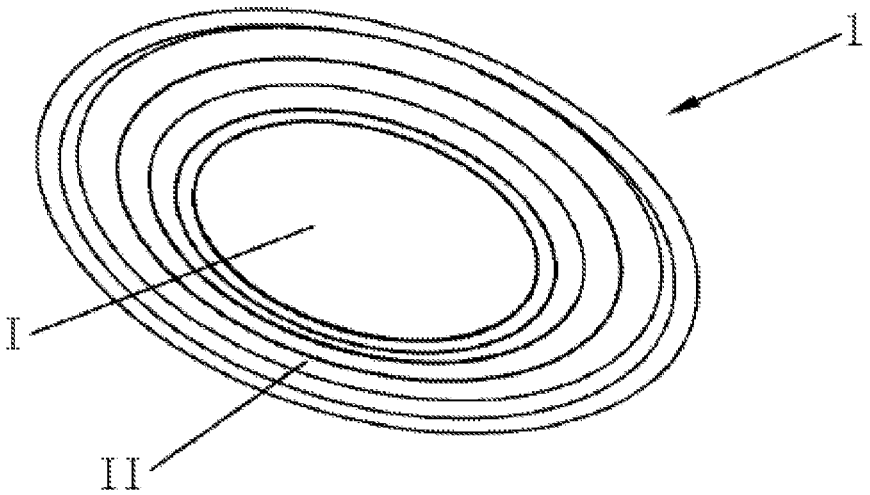
FIG. 1 is a schematic diagram of a stereostructure of a diaphragm according to the embodiment 1 of the present invention.
Figure 2:
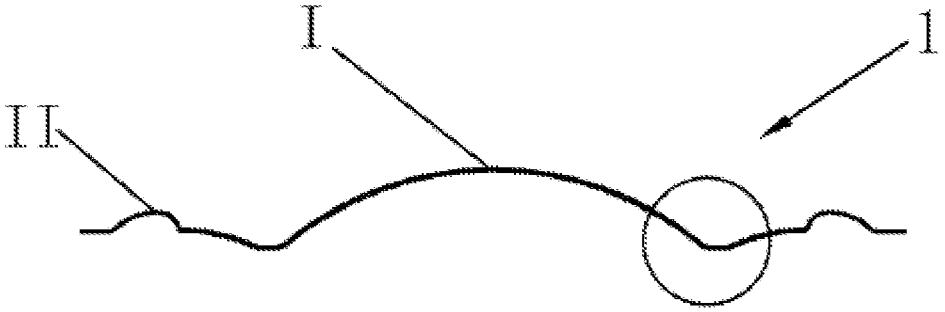
FIG. 2 is a sectional view of the diaphragm shown in FIG. 1.
Figure 3:
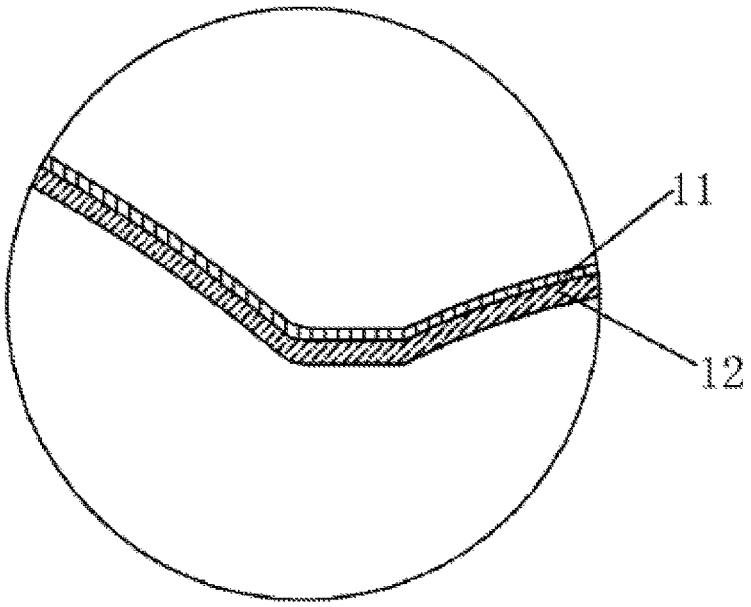
FIG. 3 is an enlarged sectional view showing part A of FIG. 2.

As shown in FIG. 1 to FIG. 3, the loudspeaker diaphragm 1 is composed of two layers of materials, and comprises the thermoplastic polyurethane 11 and the silk fabric 12 combined with the thermoplastic polyurethane 11 through hot pressing, wherein, the surface of the silk fabric 12 is coated with a curing adhesive which is not illustrated. The curing adhesive can increase the rigidity of the silk fabric 12, and preferably, the curing adhesive is a thermosetting adhesive which can be solidified at room temperature after being combined with the silk fabric, thus ensuring the stability of the silk fabric after being coated with the adhesive, wherein, the thermosetting adhesive is in a solid state during the working process of the diaphragm 1. In the diaphragm 1 including such materials, the thermoplastic polyurethane 11 has a greater internal damping, and the silk fabric 12 has a greater rigidity after being coated with the thermosetting adhesive, therefore, the diaphragm 1 has superior rigidity and damping characteristic, which can improve acoustic performance of the diaphragm 1, and particularly, improve high-frequency acoustic performance of the diaphragm 1.

Wherein, the thermosetting adhesive may be coated on one surface of the silk fabric 12, or may also be coated on two surfaces of the silk fabric 12, both of which enable the silk fabric to have certain rigidity, and the silk fabric coated with the thermosetting adhesive on one surface and two surfaces have different rigidities and can be adjusted according to the actual needs.

Wherein, when the thermosetting adhesive is coated on one surface of the silk fabric 12, the thermoplastic polyurethane 11 may be combined with the one surface of the silk fabric 12 which is coated with the thermosetting adhesive, and the thermosetting adhesive is between the silk fabric 12 and the thermoplastic polyurethane 11; the thermoplastic polyurethane 11 may also be combined with another surface of the silk fabric 12 which is uncoated with the thermosetting adhesive, and the silk fabric 12 is between the thermosetting adhesive and the thermoplastic polyurethane 11.

The diaphragm 1 of the present embodiment comprises the dome portion I located at the central position and the suspension ring portion II located at the edge position, preferably, both the dome portion I and the suspension ring portion II adopt the above diaphragm structure in which the thermoplastic polyurethane 11 and the silk fabric 12 coated with the curing adhesive are combined with each other through hot pressing. Thus, both the dome portion I and the suspension ring portion II of the loudspeaker diaphragm 1 adopt the same materials, which can simplify the forming process of the product, and due to the diaphragm 1 is capable of satisfying both rigidity and damping characteristic, which benefits to improve the acoustic performance of the loudspeaker, and particularly, the high-frequency acoustic performance of the loudspeaker.

The method of manufacturing the loudspeaker diaphragm of the present invention is as follows:

step a: coating the silk fabric with an adhesive under a high temperature, and drying the silk fabric coated with the adhesive, wherein, the adhesive is a thermosetting adhesive;

step b: combining the silk fabric 12, which is coated with the adhesive in the step a, and the thermoplastic polyurethane 11 through hot pressing under a high temperature, so as to form a membrane;

step c: pressing the membrane formed in the step b under a high temperature to form the dome portion I and the suspension ring portion II.

Wherein, in said pressing the membrane in the step c, two molds comprising an upper mold and a lower mold are used, and during the pressing, the thermoplastic polyurethane is contacted with the upper mold, and the silk fabric coated with the thermosetting adhesive is contacted with the lower mold; as the melting point of the thermoplastic polyurethane is lower than that of the thermosetting adhesive, it is preferable that the temperature of the upper mold is not higher than that of the lower mold. The membrane is pressed through the upper mold and the lower mold, and under the high temperature, the diaphragm may be formed within several seconds to tens of seconds.

Wherein, in the step c, both the thermosetting adhesive and the thermoplastic polyurethane 11 in the membrane are in the molten state under the high temperature, and then are pressed to form the dome portion I and the suspension ring portion II of the diaphragm having a certain shape. Since the melting temperature of the thermoplastic polyurethane is about 150° C., in the method of manufacturing the loudspeaker diaphragm mentioned above, the temperature may be controlled within the range of 150-230° C., and preferably, within the range of 170-230° C., and for example, the temperature may be controlled at 180° C., 200° C., 210° C. In the step a, the adhesive may be coated on two surfaces of the silk fabric, or coated on only one surface of the silk fabric. When the adhesive is coated on only one surface of the silk fabric, in the step b, the thermoplastic polyurethane 11 may be combined with the one surface of the silk fabric which is coated with the adhesive, or the thermoplastic polyurethane 11 may also be combined with another surface of the silk fabric which is uncoated with the adhesive. Such method of manufacturing the loudspeaker diaphragm enable the uniform thickness of the diaphragm and ensure the performance of the diaphragm, and thus formed diaphragm has the superior rigidity and damping characteristic, which is benefit to improve the acoustic performance of the diaphragm.

Embodiment 2

Figure 4:
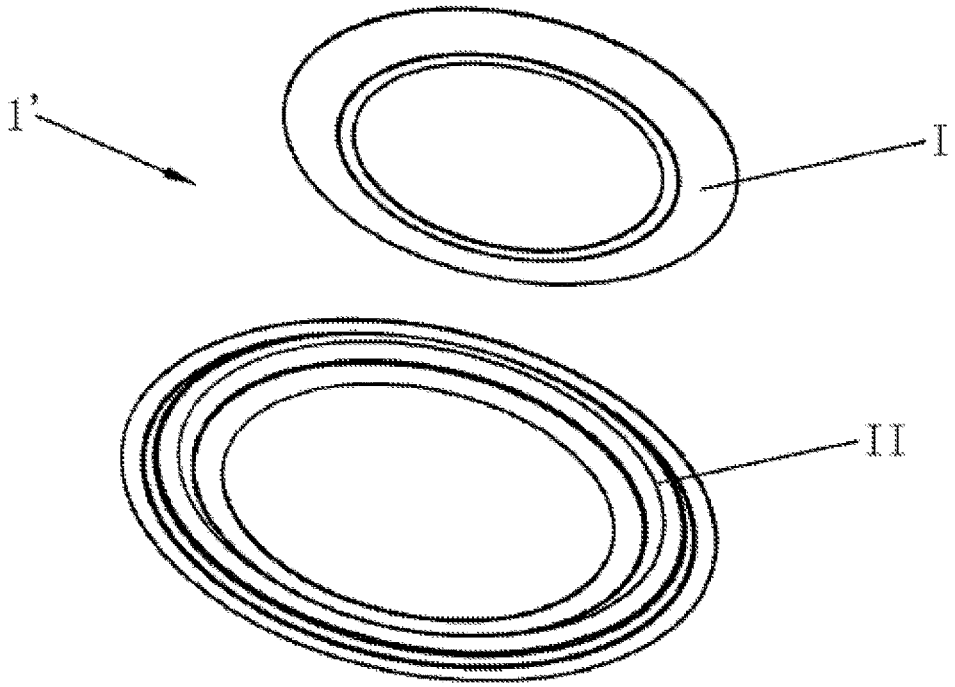
FIG. 4 is a schematic diagram of a stereostructure of a diaphragm according to the embodiment 2 of the present invention.
Figure 5:
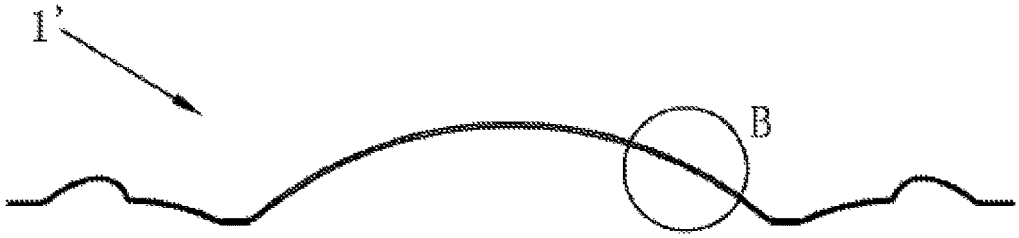
FIG. 5 is a sectional view of the diaphragm shown in FIG. 4.
Figure 6:
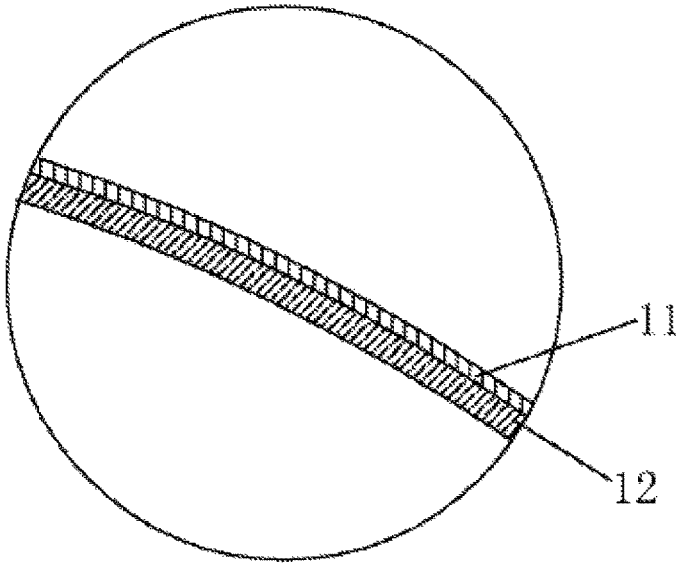
FIG. 6 is an enlarged sectional view showing part B of FIG. 5.

As shown in FIG. 4 to FIG. 6, the loudspeaker diaphragm 1' comprises the dome portion I located at the central position and the suspension ring portion II located at the edge position, wherein, the dome portion I comprises the silk fabric 12 coated with the thermosetting adhesive, and the thermoplastic polyurethane 11 combined with the silk fabric 12 through hot pressing, the thermosetting adhesive is not shown in the drawings. Wherein, the suspension ring portion II adopts other structure, and doesn't adopt the above-mentioned structure in which the dome portion I and the suspension ring portion II are fixedly combined with each other through coating adhesive, etc. The silk fabric 12 after being coated with the adhesive has a superior rigidity, and the thermoplastic polyurethane 11 has a greater internal damping, so that the dome portion I of the diaphragm 1' has superior rigidity and damping characteristic, which can markedly increase the acoustic performance of the diaphragm 1', and particularly, the high-frequency acoustic performance of the diaphragm 1'.

Similarly, the silk fabric 12 may be coated with the adhesive on one surface or two surfaces according to specific needs.

The method of manufacturing such loudspeaker diaphragm is as follows:

step a: coating the silk fabric with an adhesive under a high temperature, and drying the silk fabric coated with the adhesive, wherein, the adhesive is a thermosetting adhesive;

step b: combining the silk fabric 12, which is coated with the adhesive in the step a, and the thermoplastic polyurethane 11 through hot pressing under a high temperature, so as to form a membrane;

step c: pressing the membrane formed in the step b under a high temperature to form the dome portion I.

Wherein, in said pressing the membrane in the step c, two molds comprising an upper mold and a lower mold are used, and during the pressing, the thermoplastic polyurethane is contacted with the upper mold, and the silk fabric coated with the thermosetting adhesive is contacted with the lower mold; as the melting point of the thermoplastic polyurethane is lower than that of the thermosetting adhesive, it is preferable that the temperature of the upper mold is not higher than that of the lower mold. The membrane is pressed through the upper mold and the lower mold, and under the high temperature, the diaphragm may be formed within several seconds to tens of seconds.

Wherein, in the step c, both the thermosetting adhesive and the thermoplastic polyurethane 11 in the membrane are in the molten state under the high temperature, and then are pressed to form the dome portion I of the diaphragm having a certain shape. Since the melting temperature of the thermoplastic polyurethane is about 150° C., in the method of manufacturing the loudspeaker diaphragm mentioned above, the temperature may be controlled within the range of 150-230° C., and preferably, within the range of 170-230° C., and for example, the temperature may be controlled at 180° C., 200° C., 210° C. In the step a, the adhesive may be coated on two surfaces of the silk fabric, or coated on only one surface of the silk fabric. When the adhesive is coated on only one surface of the silk fabric, in the step b, the thermoplastic polyurethane 11 may be combined with the one surface of the silk fabric which is coated with the adhesive, or the thermoplastic polyurethane 11 may also be combined with another surface of the silk fabric which is uncoated with the adhesive. Such method of manufacturing the loudspeaker diaphragm enable the uniform thickness of the diaphragm and ensure the performance of the diaphragm, and thus formed diaphragm has the superior rigidity and damping characteristic, which is benefit to improve the acoustic performance of the diaphragm.

Under the above instructions of the present invention, other improvements and modifications may be made by those skilled in the art on the basis of the above embodiments, and the improvements and modifications are within the scope of protection of the present invention, and it should be understood by those skilled in the art that the above detailed description is only intended to explain the object of the present invention, and the scope of protection of the present invention is defined by the claims and equivalents thereof.

The invention claimed is:

1. A method of manufacturing a loudspeaker diaphragm, the method comprising the following steps:

step a: coating the silk fabric with an adhesive under a high temperature, and drying the silk fabric coated with the adhesive, wherein, the adhesive is the thermosetting adhesive;

step b: combining the silk fabric, which is coated with the adhesive in the step a, and the thermoplastic polyurethane through hot pressing, so as to form a membrane;

step c: pressing the membrane formed in the step b under a high temperature to form the dome portion and/or the suspension ring portion, wherein the adhesive is coated on only one surface of the silk fabric, and in step b, the thermoplastic polyurethane is combined with another surface of the silk fabric which is uncoated with the adhesive, wherein, in step c, the membrane is pressed between an upper mold and a lower mold, and during the pressing, the thermoplastic polyurethane is in contact with the upper mold, and the silk fabric coated with the thermosetting adhesive is in contact with the lower mold, and wherein a temperature of the upper mold is lower than a temperature of the lower mold.

2. The method according to claim 1, wherein, in the step c, both the thermosetting adhesive and the thermoplastic polyurethane in the membrane are in a molten state under the high temperature.

* * * * *